US006238616B1

(12) United States Patent
Ishikawa et al.

(10) Patent No.: US 6,238,616 B1
(45) Date of Patent: May 29, 2001

(54) METHOD OF MANUFACTURING GELATIN CAPSULE CONTAINING POWDER OR TIME RELEASE PELLETS

(75) Inventors: Toshimitsu Ishikawa; Nobuyuki Wada, both of Shizuoka (JP); Stephen Richard Lukas, Stroudsburg, PA (US)

(73) Assignee: TimeCaps Inc., Stroudsburg, PA (US)

( * ) Notice: Subject to any disclaimer, the term of this patent is extended or adjusted under 35 U.S.C. 154(b) by 0 days.

(21) Appl. No.: 09/211,505

(22) Filed: Dec. 14, 1998

(51) Int. Cl.[7] ..... B65B 3/04; B65B 3/12; B65B 47/06; B65B 47/08; B65B 47/10

(52) U.S. Cl. ..... 264/553; 264/571; 427/212; 53/452; 53/453; 53/454; 53/546; 53/548; 53/553; 53/900

(58) Field of Search ..... 428/402, 403, 428/478.2; 53/452, 453, 454, 546, 547, 548, 553, 900; 264/109, 553, 571, 544; 427/212

(56) References Cited

U.S. PATENT DOCUMENTS 3,579,960 * 5/1971 Mehta ..... 53/184
4,154,636 * 5/1979 Motoyama et al. ..... 156/243
4,307,555 * 12/1981 Mlodozeniec et al. ..... 53/53
4,567,714 * 2/1986 Chasman ..... 53/438
4,817,367 * 4/1989 Ishikawa et al. ..... 53/454
5,146,730 9/1992 Sadek et al. ..... 53/454
5,740,660 * 4/1998 Rowe ..... 53/454

* cited by examiner

*Primary Examiner*—Vivian Chen
(74) *Attorney, Agent, or Firm*—Gifford, Krass, Groh, Sprinkle, Anderson & Citkowski, P.C.

(57) ABSTRACT

A manufacturing method for forming gelatin capsules comprising:

supplying two gelatin sheets having preformed pockets between die rollers;

partially suturing the gelatin sheets together by means of the die rollers to form a pocket;

weighing powder or particulate capsule content in a weighing hole aligned with said pocket;

utilizing a pusher to push said capsule content through said weighing hole and into the pocket; and completing the suturing of the gelatin sheets by means of the die rollers to envelop said capsule content in said pocket.

2 Claims, 15 Drawing Sheets

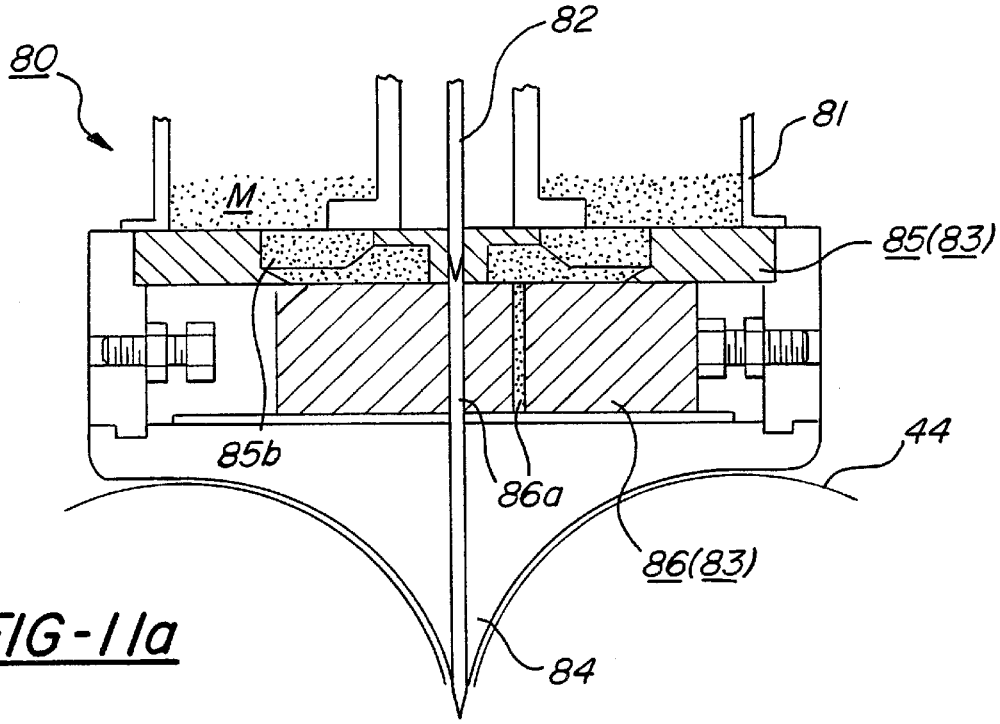
FIG-11a
FIG-11b
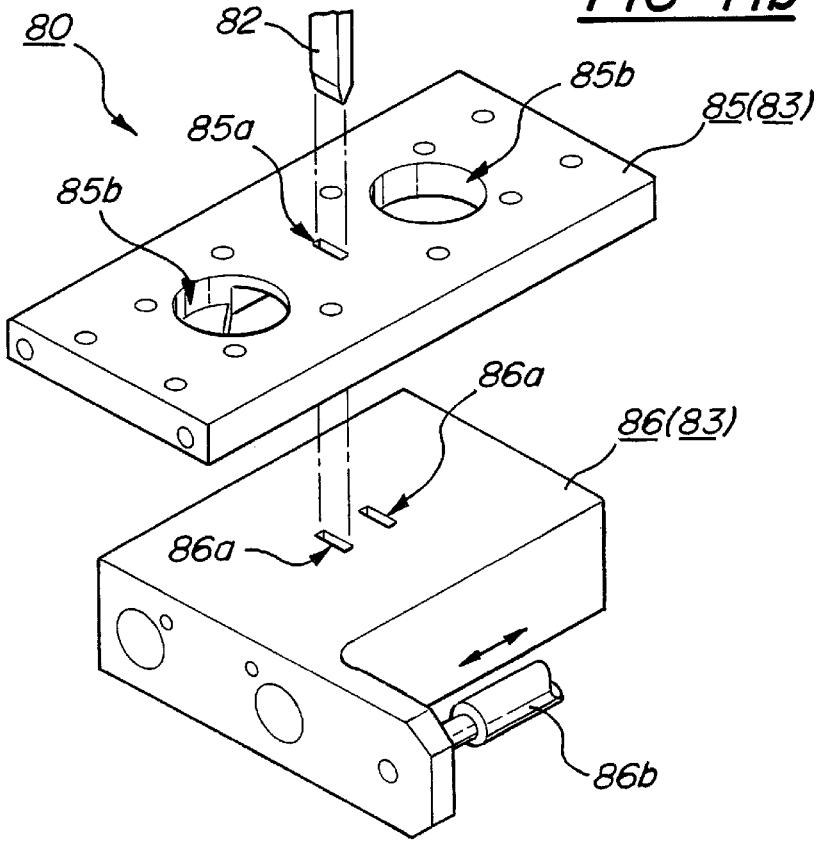

METHOD OF MANUFACTURING GELATIN CAPSULE CONTAINING POWDER OR TIME RELEASE PELLETS

BACKGROUND OF THE INVENTION

I. Field of the Invention

The present invention relates to a gelatin capsule of soft type containing medicine or the like, and more particularly to a novel gelatin capsule capable of containing powder or time release pellets as the content, and its manufacturing method and manufacturing apparatus.

II. Description of Related Art

Various gelatin capsules of soft type enveloping medicine or nutrient with soft gelatin in a form of capsule for the ease of king are sold on market. In manufacture of such gelatin capsule (in the specification, the gelatin capsule refers to the soft capsule hereinafter), molten gelatin is first formed into sheets, and the gelatin sheets are supplied into a pair of die rolls to be formed like a folder. The content such as medicine is supplied from above between them, the content spreads widely the sheets to form a pocket fitted to the inner circumference of the forming protrusions in the die rolls, and the forming protrusion sutures the periphery of the content in a fused state, thereby forming a gelatin capsule.

The present applicant acquired the patent by applying a "gelatin sheet forming apparatus in a gelatin capsule manufacturing apparatus" (Japanese Patent Application Publication No. 5-88143; Japanese Patent No. 1876976) for the purpose of lowering the cooling cost of cooling drum and eliminating germs mixing into cooling air in a manufacturing apparatus of gelatin for manufacturing gelatin capsules in such manner. The present applicant also acquired the patent by applying an "adjusting apparatus in a manufacturing apparatus of gelatin capsule" (Japanese Patent Application Publication No. 5-88144; Japanese Patent No. 1876977) for the purpose of facilitating adjustment of thickness of gelatin sheet and adjustment of compressed state of die rolls, and reducing waste of materials due to these adjustments occurring in the preparatory stage before start of production.

Furthermore, the present applicant acquired the patent by applying a "capsule taking-out apparatus in a manufacturing apparatus of gelatin capsule" (Japanese Patent Application Publication No. 5-88145; Japanese Patent No. 1876978) for the purpose of adjusting and checking the scraping brush for die rolls and scraping brush for blank sheets separately from the die rolls, and therefore various problems of the conventional manufacturing apparatus of gelatin capsule have been solved, which contributes to presentation of more practical manufacturing apparatus of gelatin capsules.

Even in such gelatin capsules, however, the following problems are known, and further improvements are needed. That is, generally, as the content in this kind of gelatin capsule, only liquid or suspension containing powder appearing to be liquid by mixing powder in liquid was used, and when containing fine or granular powder or time release pellets, a hard capsule was used instead of soft capsule. But it is easier to take in the form of soft capsule than in the form of hard capsule, and for the purpose of protecting the contained medicine more safely, development of gelatin capsule containing powder has been proposed.

If attempted to contain powder or time release pellets actually in such gelatin capsule, it was hard to realize due to the following technical problems. That is, when manufacturing gelatin capsule, if the content is liquid, as shown in FIG. 15, liquid L supplied from a nozzle 84' pushes open the gelatin sheets S as indicated by arrow f to the inner circumference of forming protrusions 45' to suture a pair of gelatin sheets S, and relatively smooth manufacturing is realized. However, if the content is powder or time release pellets, the action for pushing open by the content is not expected as in the case of liquid L, and still worse if the pair of gelatin sheets S come closer to each other to narrow the peripheral space of the content, the powder or time release pellets may scatter about due to this effect, and may be adhered to the suture surface of gelatin sheets S, so that the sheets may not be sutured.

BRIEF SUMMARY OF THE INVENTION

The invention is devised in recognition of such background, and is intended to develop a novel gelatin capsule constituted for deforming gelatin sheets supplied between a pair of die rolls into a shape fitted to the inner circumference of the forming protrusion of die rolls, forming a pocket, and enveloping the powder, and its manufacturing method and apparatus.

A gelatin capsule comprises a capsule sheath made of a pair of confronting gelatin sheets as starting material and formed integrally like a folder, and the content enveloped by the capsule sheath, in which the content is fine or granular powder or time release pellets, and the capsule sheath has a pocket formed for receiving the content in the gelatin sheets preliminarily before completion of filling with the content.

According to the invention, only the powder or pellets can be contained in the gelatin capsule which is a soft capsule, and it is easier to take, and the gelatin capsules protecting the powder or pellets perfectly are provided in a wide variety.

In a gelatin capsule, in addition to the above requirements, the pocket is formed by sucking from the inside of forming protrusions in die rolls for forming the gelatin capsule.

According to the invention, the suction mechanism of supplied gelatin sheets may be applied in the conventional manufacturing apparatus, and the cost of gelatin capsules containing powder or pellets can be lowered.

A manufacturing method of gelatin capsule comprises the steps of supplying two gelatin sheets between a pair of die rolls for forming the capsule sheath in a gelatin capsule, supplying the content from above, and enveloping the content between the gelatin sheets by the action of forming and protruding by the die rolls, in which the content is fine or granular powder or pellets, and the capsule sheath has a pocket formed for receiving the content in the gelatin sheets preliminarily before completion of filling with the content.

According to the invention, manufacturing of gelatin capsule containing powder or pellets only is more realistic, and the method of forming the pocket for containing powder or pellets in gelatin sheets may include various processing methods, such as suction, embossing and pressing.

In a manufacturing method of gelatin capsule, in addition to the requirements above, the pocket is formed by sucking from the inside of the forming protrusions in the die rolls for forming the gelatin capsule.

According to the invention, the suction mechanism of gelatin sheets may be incorporated into the conventional manufacturing apparatus, and the entire apparatus may be designed compact.

A manufacturing apparatus of gelatin capsule is for supplying two gelatin sheets between a pair of die rolls, supplying the content from above through the nozzle, and enveloping the content by the action of forming and protruding by the die rolls, which comprises a mechanism for forming a pocket in a shape fitted to the inner circumference of the forming protrusions in the die rolls in the gelatin sheets in a transfer According to the invention, manufacturing of gelatin capsule containing powder or pellets only is more realistic, and the position for the apparatus for forming the pocket may be selected from a wide variety.

In a manufacturing apparatus of gelatin capsule, in addition to the requirements above, the pocket forming mechanism is formed by sucking from the inside of the forming protrusions in the die rolls for forming the gelatin capsule.

According to the invention, the suction apparatus of gelatin sheets can be applied in the conventional manufacturing apparatus, and mass production is realized.

DESCRIPTION OF THE DRAWINGS

FIGS. 11(A), 11(B). A longitudinal front view and perspective exploded view showing powder/pellet feeding device.

DETAILED DESCRIPTION OF THE INVENTION

Figure 1:
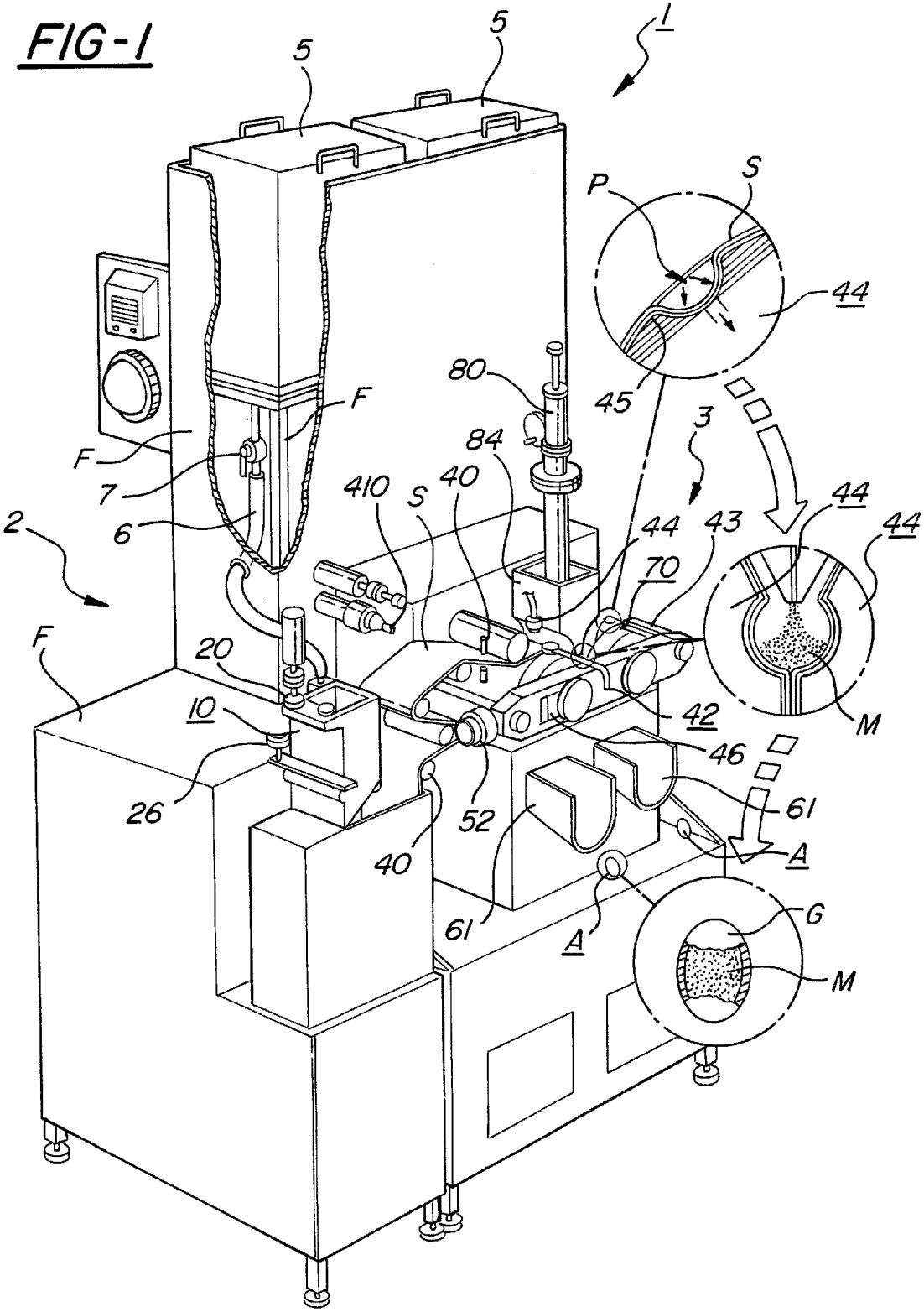
FIG. 1. A perspective view showing a manufacturing apparatus of gelatin capsule.

The invention is described below by referring to the illustrated embodiments. In the following explanation, first the gelatin capsule A of the invention is described, then the manufacturing apparatus 1 of the gelatin capsule is described together with the explanation about the manufacturing method of the gelatin capsule A. The gelatin capsule A, in its completed state as shown in FIG. 1, contains a capsule sheath G made from a starting material of gelatin sheets S, and powder or pellet M as the content to be enveloped therein. This capsule sheath G is formed, as specifically described later, by supplying a pair of gelatin sheets S as starting material oppositely to each other, and fusing by forming integrally like a folder. The powder or pellets M, or the content, may be a material suited to the purpose, including medicine, nutrient, health food extract, seasoning, or the like.

Figure 2:
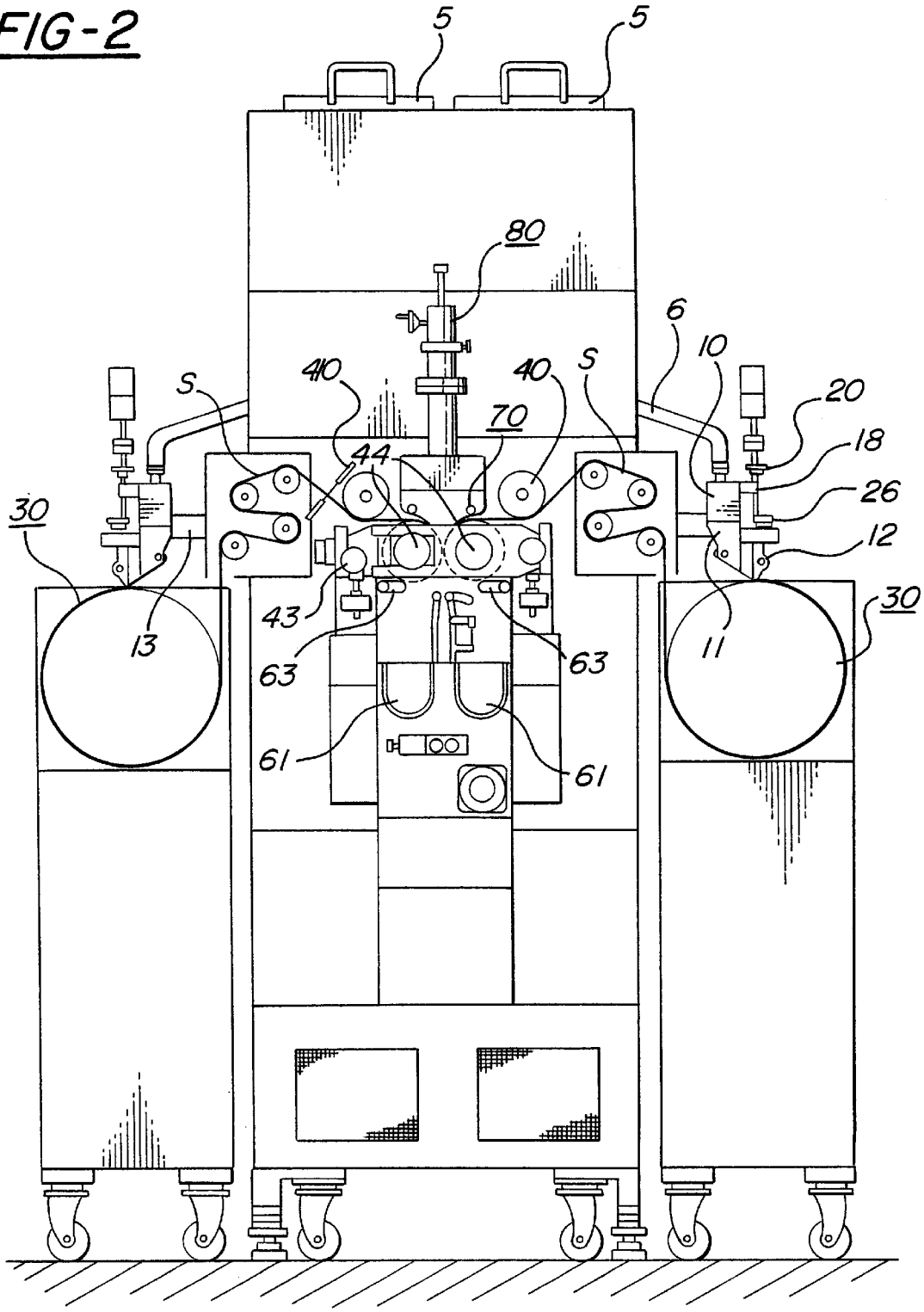
FIG. 2. A front view of the same.

The manufacturing apparatus 1 of gelatin capsule is described below. As shown in FIGS. 1 and 2, it mainly consists of a sheet forming unit 2 and a capsule forming unit 3, and these members are assembled in a frame F. Relating first to the sheet forming unit 2, two gelatin sheets S are supplied in a folder state into the capsule forming unit 3, and are formed, for example, like a spindle in the capsule forming unit 3, and hence the front and rear sheet forming units 2 are disposed symmetrically in pair to the right and left of the frame F.

This constitution is not, however, limitative, and, for example, a gelatin sheet S may be formed by one sheet forming unit 2, and it may be cut into two pieces by any proper means before reaching the capsule forming unit 3, and supplied oppositely.

First of all, a gelatin tank 5 is provided above the sheet forming unit 2. This is to contain fused gelatin, and since this embodiment relates to a relatively compact apparatus suited to a relatively small quantity production or experimental manufacture, it is sufficiently practical and usable when the gelatin tank 5 filled with gelatin, but to be suitable to mass production, instead of this gelatin tank 5, a gelatin hopper or the like capable of supplying freely may be suspended above a processing plant by a hoist crane or the like to supply gelatin.

From this gelatin tank 5, a feed hose 6 is drawn out downward, and a valve 7 is provided on the way. In the gelatin tank 5, moreover, a heater is provided for keeping the fused state of gelatin. The gelatin supplied from the feed hose 6 of this gelatin tank 5 is fed into a spreader box 10 disposed beneath it, and this spreader box 10 is described in detail below.

It is nearly in a wedge shape in a front view as shown in FIGS. 3 to 6, consisting of a main body 11 and an adjusting weir plate 12 attached movably to its side, and the main body 11 is constituted so as to be fixed to the frame F by a fixing bracket 13. A float valve 14 is provided in the main body 11. It is a common one composed of a float and a valve disposed at the connection end of the feed hose 6, and when the spreader box 10 is filled sufficiently with gelatin, the float in the float valve 14 ascends to close the valve, so that a specific amount of gelatin may be always present in the spreader box 10.

Besides, such main body 11 and adjusting weir plate 12 are individually provided with a heater 15 for keeping the fused state of gelatin. At the lower end of the main body 11, a slit-like discharge hole 16 is formed at the lower end of the adjusting weir plate 12, from which the fused gelatin in the spreader box 10 is discharged.

Next is described the opening adjusting mechanism of this adjusting weir plate 12. First, reference numeral 18 is an adjusting rod forming threads on the periphery, and it is engaged with female threads 19 integrally formed on the adjusting weir plate 12. At the upper end of the adjusting rod 18, a dial 20 is provided for rotating it, and at its lower end, an abutting end 21 is formed, and is abutting against a reference end 22 fixed at the main body 11 side.

Reference numeral 23 is a set spring, which acts to press the adjusting weir plate 12 side always downward. Reference numeral 24 is a rod guide formed at the main body 11 side. Between the adjusting weir plate 12 and main body 11, a dial gauge 26 is provided for monitoring the adjusting state visually, and the main body of this dial gauge 26 is provided at the main body 11 side of the spreader box 10, and a plunger 27 of the dial gauge 26 is abutting against a detecting protrusion, 28 moving together with the adjusting weir plate 12.

Therefore, the dial gauge 26 is constituted so that its opening state or fully closed state may be expressed as a specific numerical value when, for example, the discharge hole 16 is adjusted to zero at a proper reference position, such as the fully closed state or open state of highest frequency of use.

In this embodiment, incidentally, since the gelatin discharge amount is required to be adjusted very finely, even a slightest inclination of the adjusting weir plate 12 is not permitted, and hence dial gauges 26 are provided at the right and left side of the adjusting weir plate 12, and in the mechanism hardly causing such inclination of the adjusting weir plate 12, or in the case of occurrence of slight degree, it may be adjusted by disposing only one unit of dial gauge 26 or adjusting rod 18 in the central part.

Figure 3:
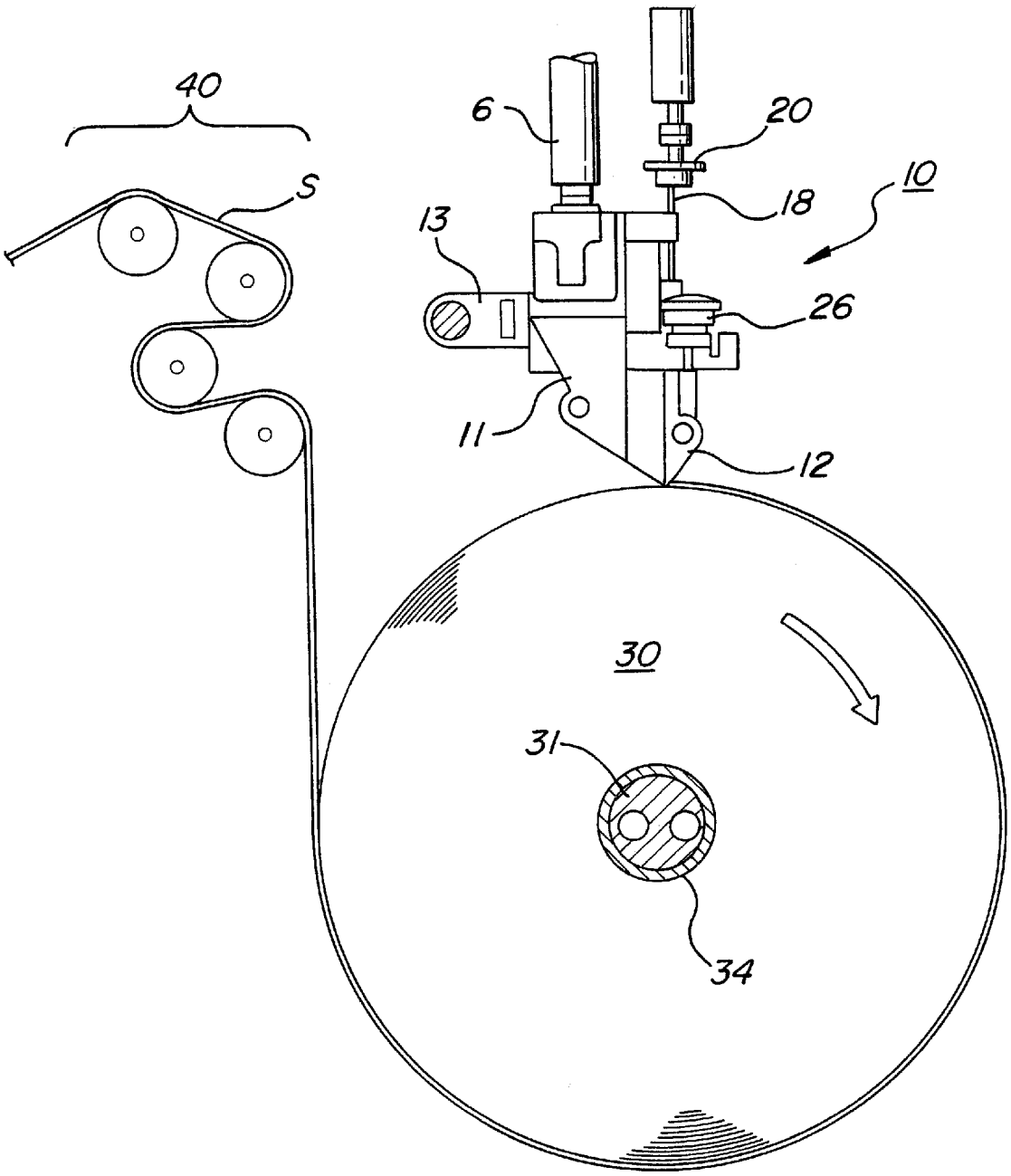
FIG. 3. A magnified front view around spreader box, cooling drum and feed roll.
Figure 4:
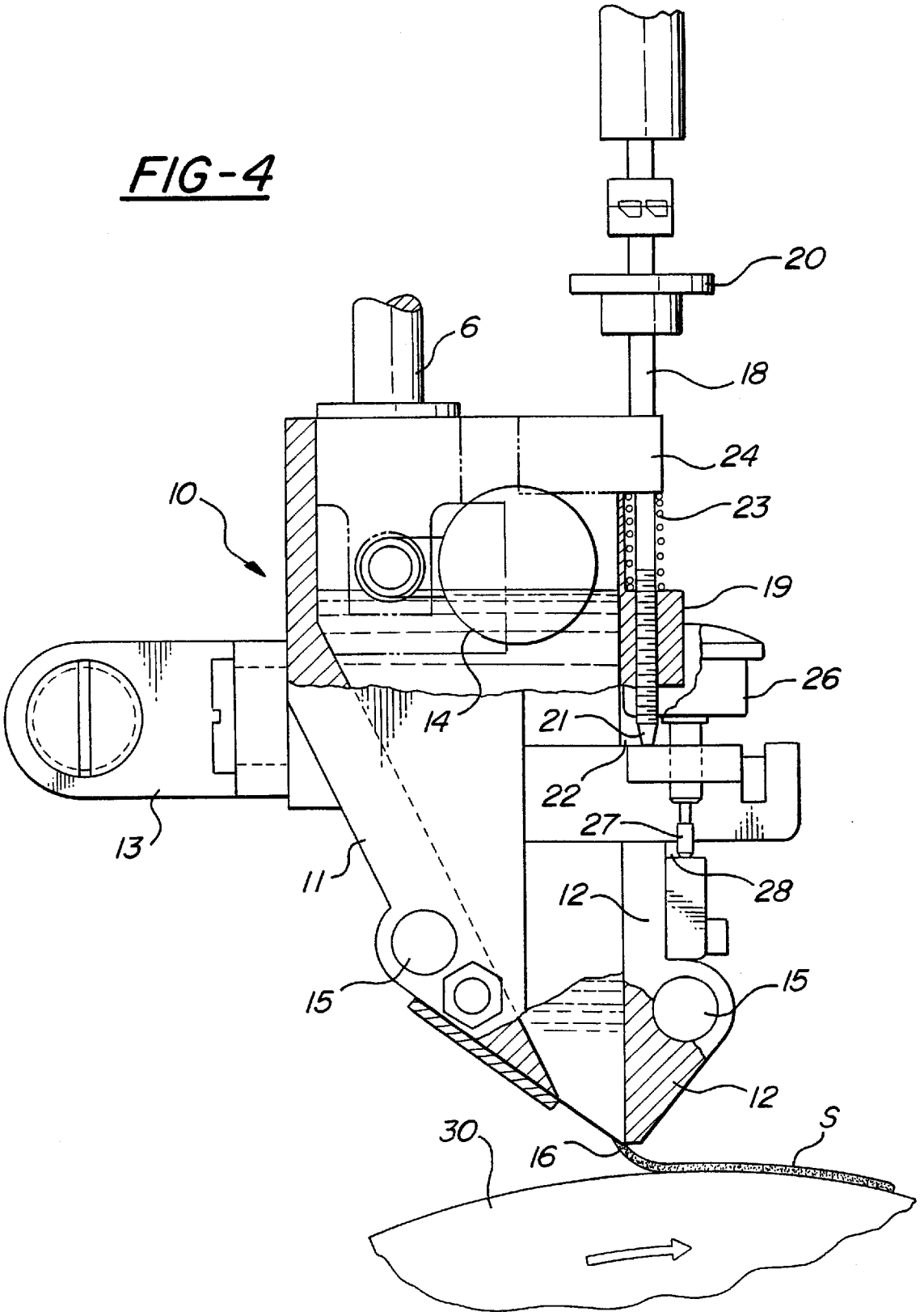
FIG. 4. A further magnified front view of spreader box.
Figure 5:
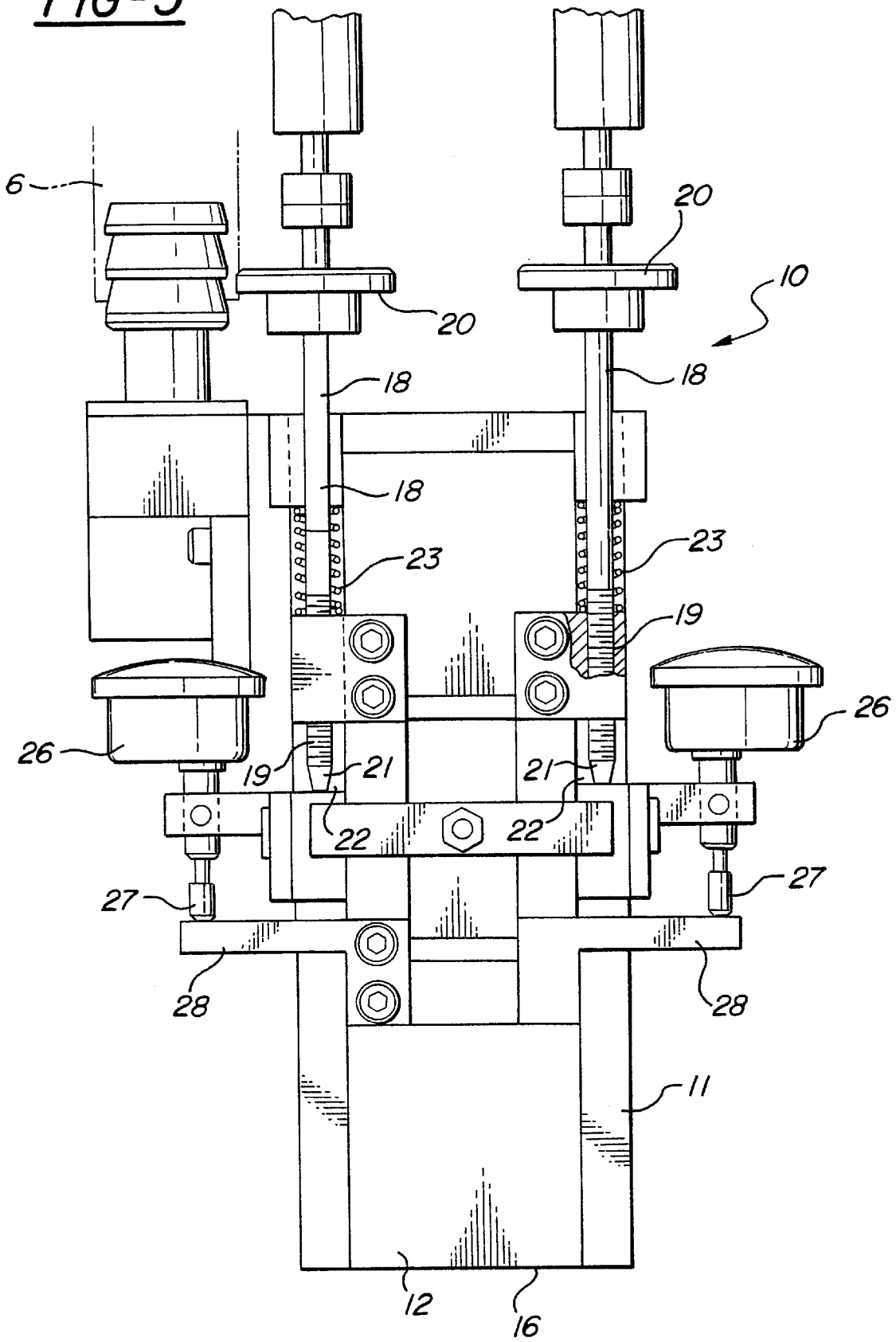
FIG. 5. A side view of FIG. 4.
Figure 6:
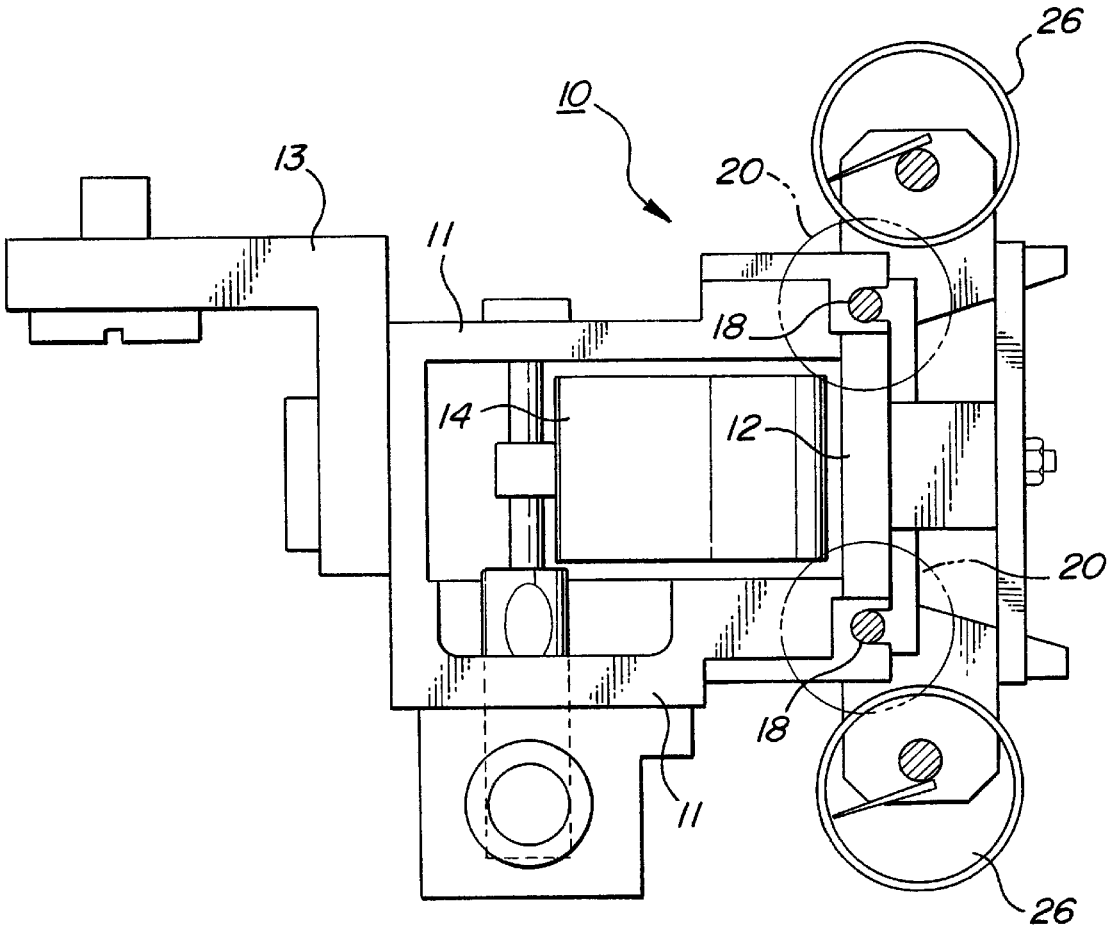
FIG. 6. A plan view of FIG. 4.
Figure 7:
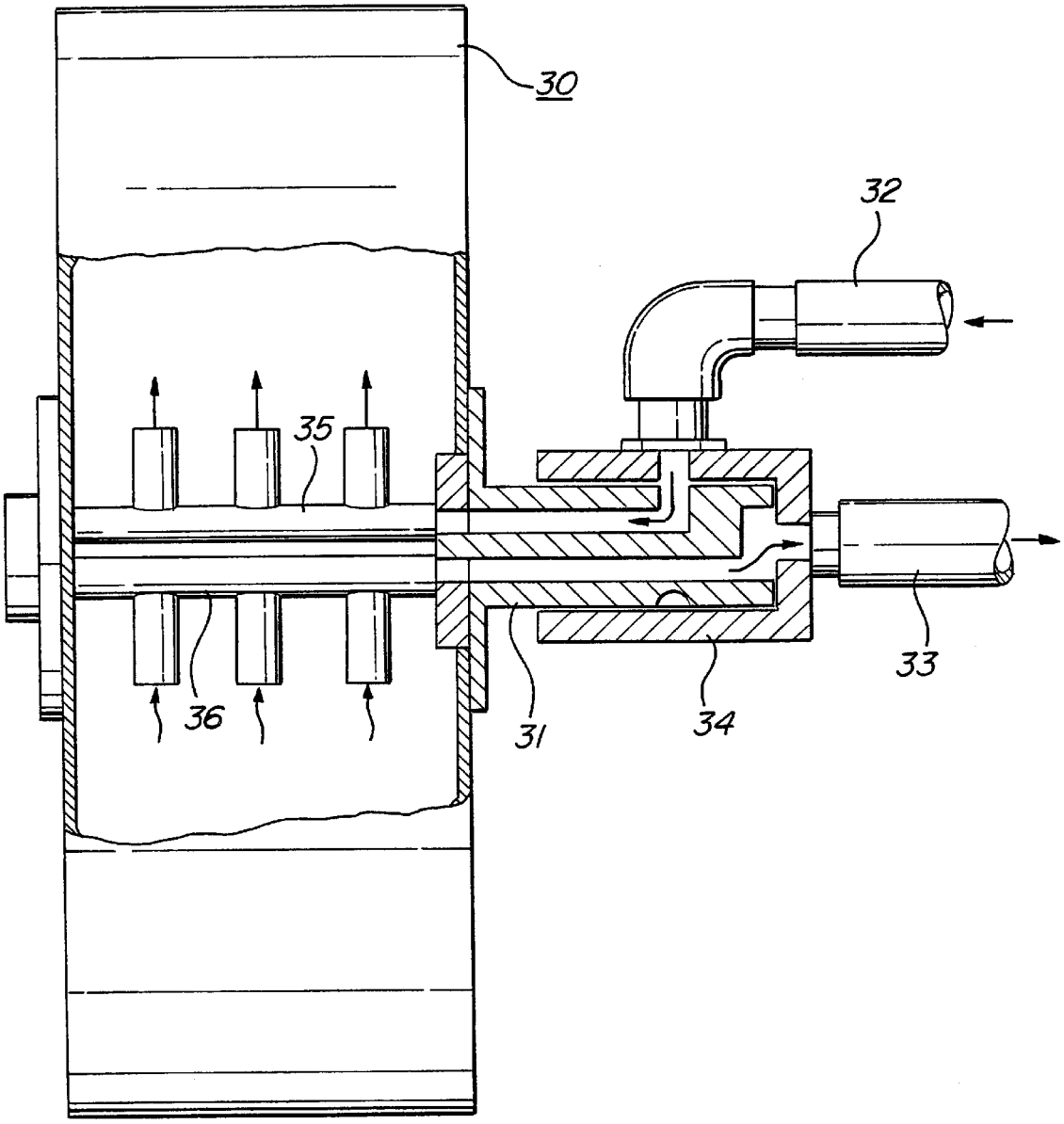
FIG. 7. A magnified longitudinal side view around cooling drum.

Beneath the spreader 10, a cooling drum 30 is disposed, and it is rotatably supported on a frame F by a shaft 31 as shown in FIGS. 3 and 7, and is driven by a proper motor. On this shaft 31, feeding means of cooling medium is formed. Reference numeral 32 is a cooling medium feed hose, and 33 is a cooling medium recovery hose. These hoses are connected to a coupling 34, which is externally fitted to the shaft 31 so as to supply and recover the cooling medium.

From each opening of the shaft 31, a cooling medium discharge pipe 35 and a cooling medium recovery pipe 36 are extended and formed in the cooling drum 30. Such cooling medium is supplied or recovered from a refrigerating machine unit. As the refrigerating machine unit, a general refrigerating machine unit can be applied, and detailed description is omitted.

The device thus described is the sheet forming unit 2, and at its later stage, that is, at the supply side of the gelatin sheet S, the capsule forming unit 3 is provided, and a feed roll 40 is formed to connect between them. That is, the gelatin sheets S being cooled through the cooling drum 30 are charged into the capsule forming unit 3 while passing zigzag between plural feed rolls 40.

Near the feed roll 40, there is a thickness sensor 410 for measuring the thickness of gelatin sheets S charged into the capsule forming unit 3. The detail of the thickness sensor 410 is omitted herein because it is described in Japanese Patent Application Laid-open Patent No. 8-182144 "Thickness measuring apparatus of gelatin sheet in a manufacturing apparatus of gelatin capsule." In this embodiment, the cooling drum 30 is separate from the apparatus main body, but it is possible also to incorporate it into the apparatus main body same as in the prior art depending on the plant layout, and invert the gelatin sheets S to feed into the capsule forming unit 3.

Figure 8:
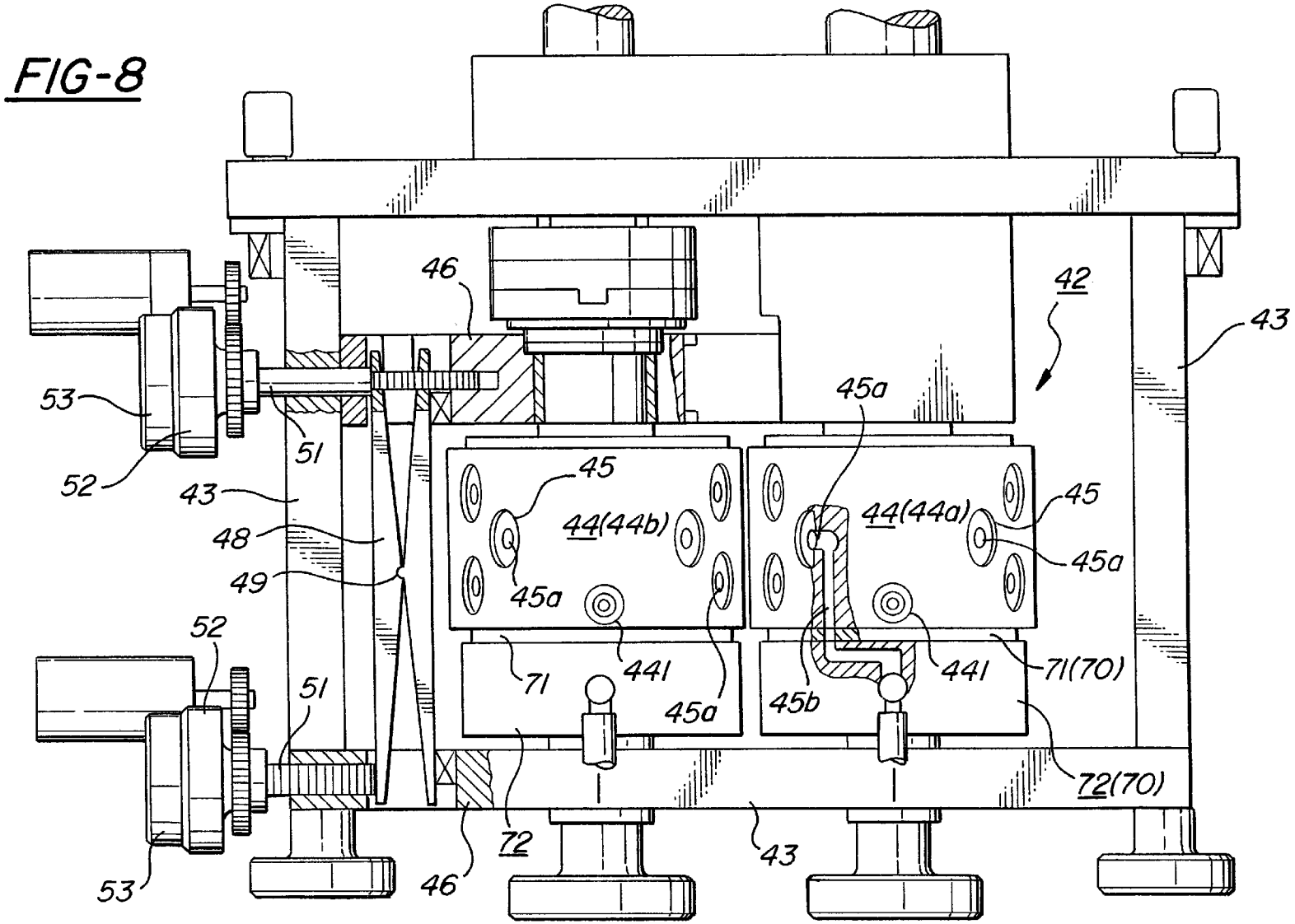
FIG. 8. A magnified lateral side view around die head.
Figure 9:
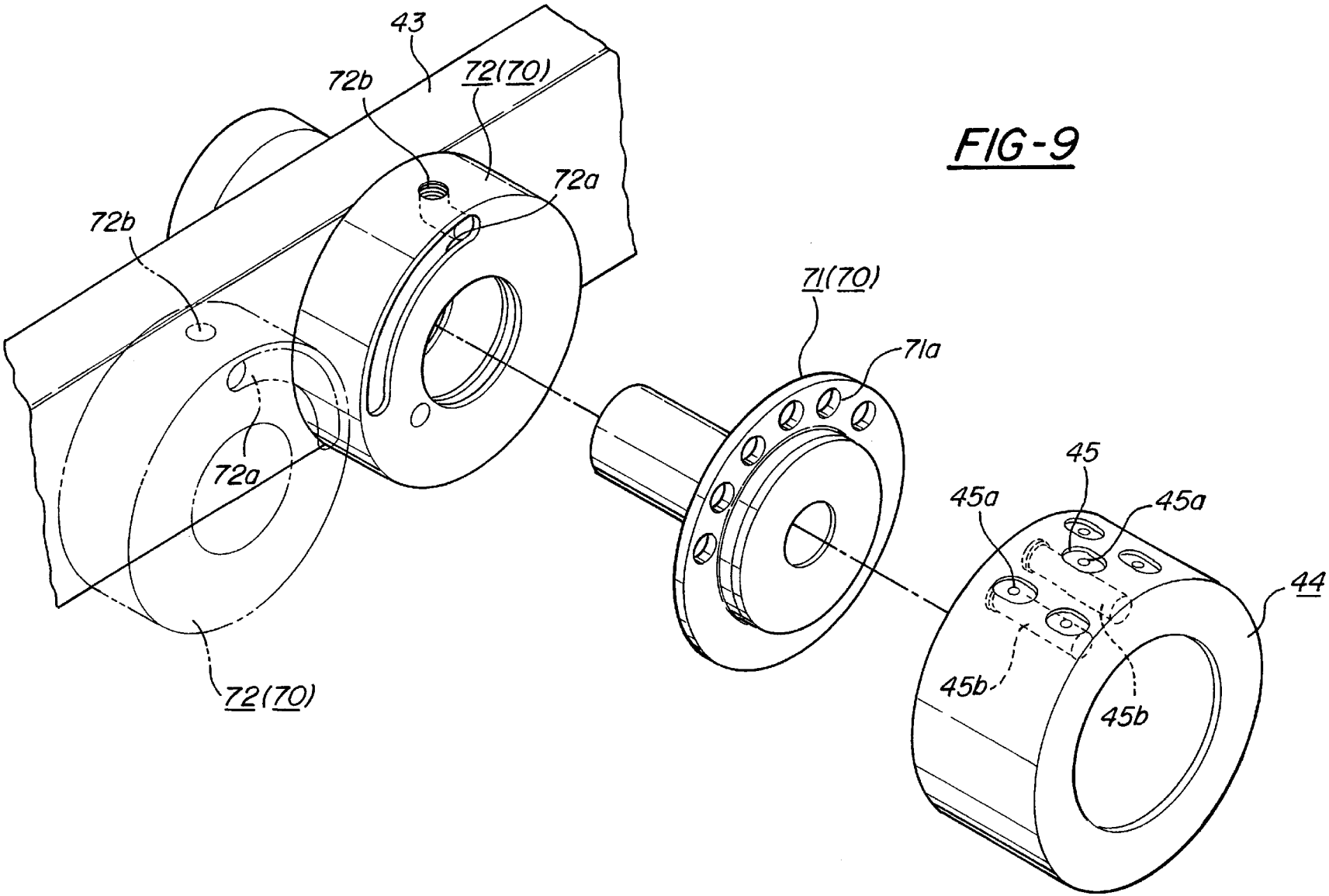
FIG. 9. A perspective exploded view showing die rolls and suction mechanism.
Figure 10:
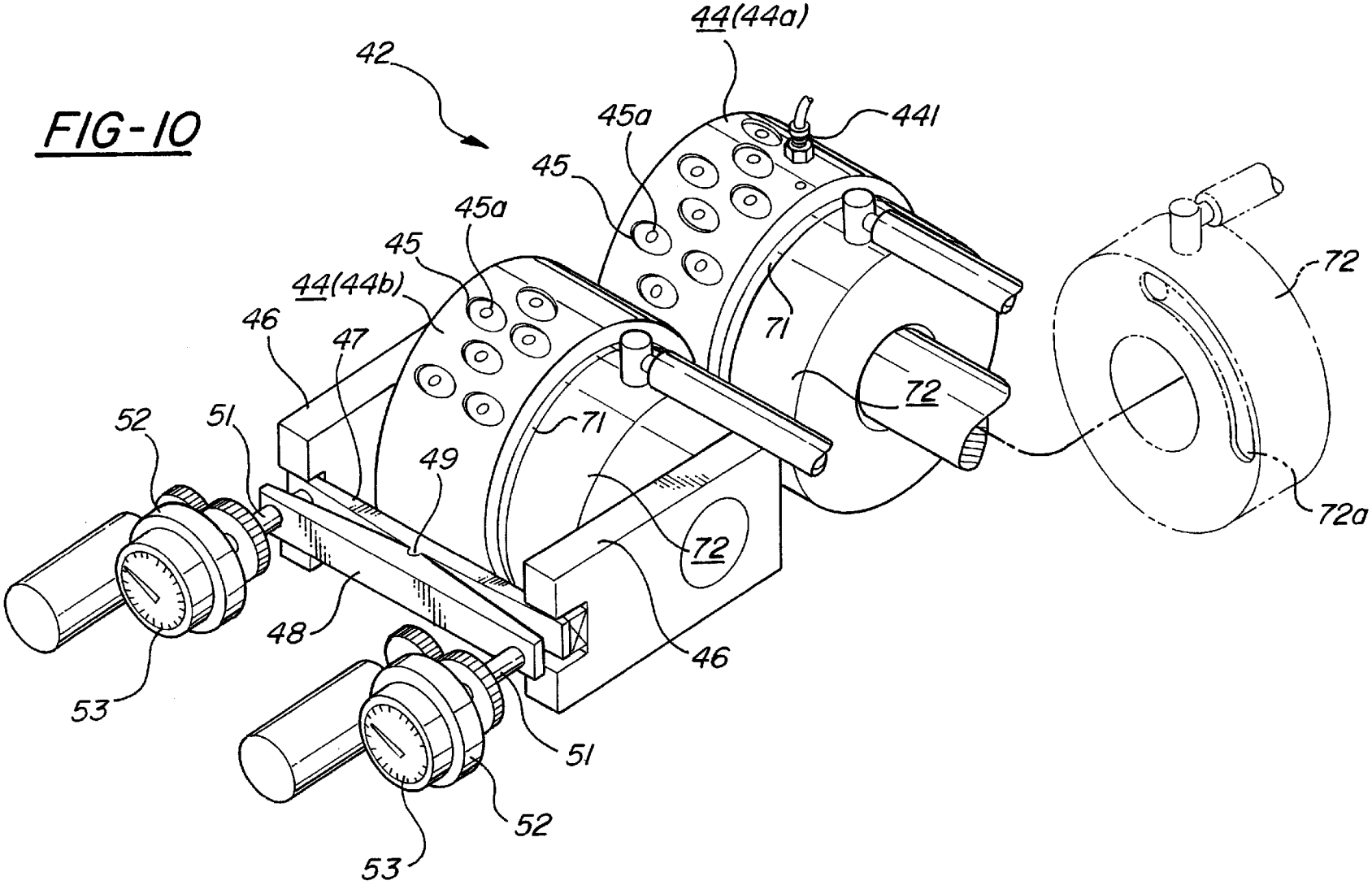
FIG. 10. A perspective view of FIG. 8.

The capsule forming unit 3 is described below. As shown in FIGS. 8, 9, 10, reference numeral 42 is a die head which is a principal member of the capsule forming unit 3, and it is formed by disposing a pair of die rolls 44 on a die roll frame 43. One of the pair of die rolls 44 is fixed, and the other is disposed to be free to move closer to this fixed die roll 44, and if necessary to distinguish them, one is called the fixed die roll 44*a* and the other is called the movable die roll 44*b*.

In each die roll 44, adequate forming protrusions 45 are formed on the surface, and when forming, for example, a gelatin capsule A having a shape like spindle, the shape is elliptical having a recess in the center, and a suction hole 45*a* is formed in the inner circumference of each forming protrusion 45 for sucking the supplied gelatin sheets S. As shown in FIG. 9, it communicates with a suction path 45*b* formed in the bottom of each suction hole 45*a*, and the suction path 45*b* is extended from the die roll frame 43 side end up to the suction hole 45*a*. In this embodiment, the number of suction holes 45*a* communicating with one suction path 45*b* is either one or two, but if it is difficult to adhere the gelatin sheet S uniformly to the inner circumference of the forming protrusions 45, the number of forming protrusions 45 formed in the width direction of the die roll 44 may be set uniform, so that the number of suction holes 45*a* communicating with one suction path 45*b* may be always specific.

Between the die roll 44 and die roll frame 43, a sheet suction mechanism 70 is composed, and it comprises a die roll rest 71 rotating together with the die roll 44, and a suction main body 72 mounted on the die roll frame 43.

The die roll rest 71 is internally fitted to the die roll 44, and is fixed on the die roll 44 by bolts, and a peripheral edge almost same as the outer circumference of the die roll 44 is formed. On the peripheral edge, communication holes 71*a* are formed in the same dimensions and same number as the suction paths 45*b* of the die roll 44. In this embodiment, the die roll 44 and die roll rest 71 are formed separately, but they may be also formed integrally.

On the other hand, in the suction main body 72, suction grooves 72*a* are formed on the die roll rest 71 side surface in a range of 90 degrees from above to the suction side of gelatin sheet S, and the upper part of the suction grooves 72*a* is formed to be consecutive to vacuum holes 72*b* formed on the top of the suction main body 72. When suction from the vacuum holes 72*b* starts, it is transmitted to the suction paths 45*b* of the die roll 44 rotating through the die roll rest 71, and the gelatin sheet S is deformed in a shape fitted to the inner circumference of the forming protrusions 45 only in a range of rotating the suction holes 45*a* by 45 degrees from above corresponding to the suction grooves 72*a* of the suction main body 72, so that a pocket P is formed. Including the sheet suction mechanism 70 and suction holes 45*a* and suction paths 45*b* of the die roll 44, the mechanism substantially contributing to formation of the pocket P is called the forming mechanism of pocket P.

The adjusting mechanism of contact pressure of the die roll 44 is explained. As shown in FIG. 8 and FIG. 10, the bearing 46 of the movable die roll 44*b* is formed oscillatably at the other fixed die roll 44*a* side relatively to the die roll frame 43, and a pair of front and rear leaf springs 47, 48 for pressing are composed to act on the bearing 46.

That is, the pair of leaf springs 47, 48 contact with each other through a central contact portion 49 projecting in the center, and the leaf spring 47 at the side closer to the bearing 46 contacts with the bearing 46 at both ends, so that the bearing 46 is pushed to the fixed die roll 44*a* side.

At both ends of the other leaf spring 48, an adjusting push rod 51 contacts, and this adjusting push rod 51 is composed to be engaged with the die roll frame 43, and an adjusting dial 52 is provided at its operating end, and it is composed so that a stronger contact pressure may be obtained when this adjusting push rod 51 is tightened further. This contact pressure is quantitatively detected by a pressure gauge 53.

Moreover, the capsule forming unit 3 including the pair of die rolls 44 is provided a position deviation detecting mechanism 441 for detecting occurrence of position deviation in the circumferential direction of the die roll 44. The detail of this position deviation detecting mechanism 441 is omitted, and should be referred to Japanese Patent Application Laid-open Patent No. 8-182743 (Position deviation monitoring device of die rolls in manufacturing apparatus of gelatin capsule).

A powder or pellet feeding device 80 is described. It comprises, as shown in FIG. 11, a powder or pellet hopper 81 for storing powder or pellets M as the content, a pusher 82 provided inside for pushing out a specific amount of the powder or pellets M, a weighing mechanism 83 provided beneath for weighing a specific amount of powder or pellets M, and a powder or pellet nozzle 84 for feeding the powder or pellets M into the die rolls 44. The pusher 82 is a columnar member with square or circular section, and is composed to slide up and down at specified timing.

The weighing mechanism 83 comprises a top plate 85 and a slider plate 86, and the pusher 82 penetrates nearly in the center of the top plate 85. A passing hole 85*a* is formed, and at both right and left sides thereof, feedholes 85*b* of powder or pellets M are formed. In the slider plate 86, plural weighing holes 86*a* are formed for storing the powder or pellets M temporarily and weighing a specific amount, and a cylinder 86*b* are provided for sliding the slider plate 86 laterally.

The powder or pellets M supplied from the feed hole 85*b* in the top plate 85 is put into the weighing hole 86*a* in the slider plate 86 to be weighed by a specific amount, and is pushed by the pusher 82 and discharged from the powder nozzle 84. Consequently, when the pusher 82 slides upward, the slider plate 86 slides laterally, and powder or pellets M are supplied again into the vacated weighing hole 86*a,* and the other weighing hole 86*a* filled with the powder or pellet M is simultaneously set beneath the pusher 82. The powder nozzle 84 has its end projecting so as to penetrate sufficiently into the die rolls 44, as shown in FIG. 11 (*a*), and further in the case that the powder or pellets M are fine particles, in order to prevent clogging of the feed holes 85*b* with the powder or pellets M in the powder hopper 81, a screw or mechanical agitating device, or a nozzle for feeding agitating air may be provided.

Figure 12:
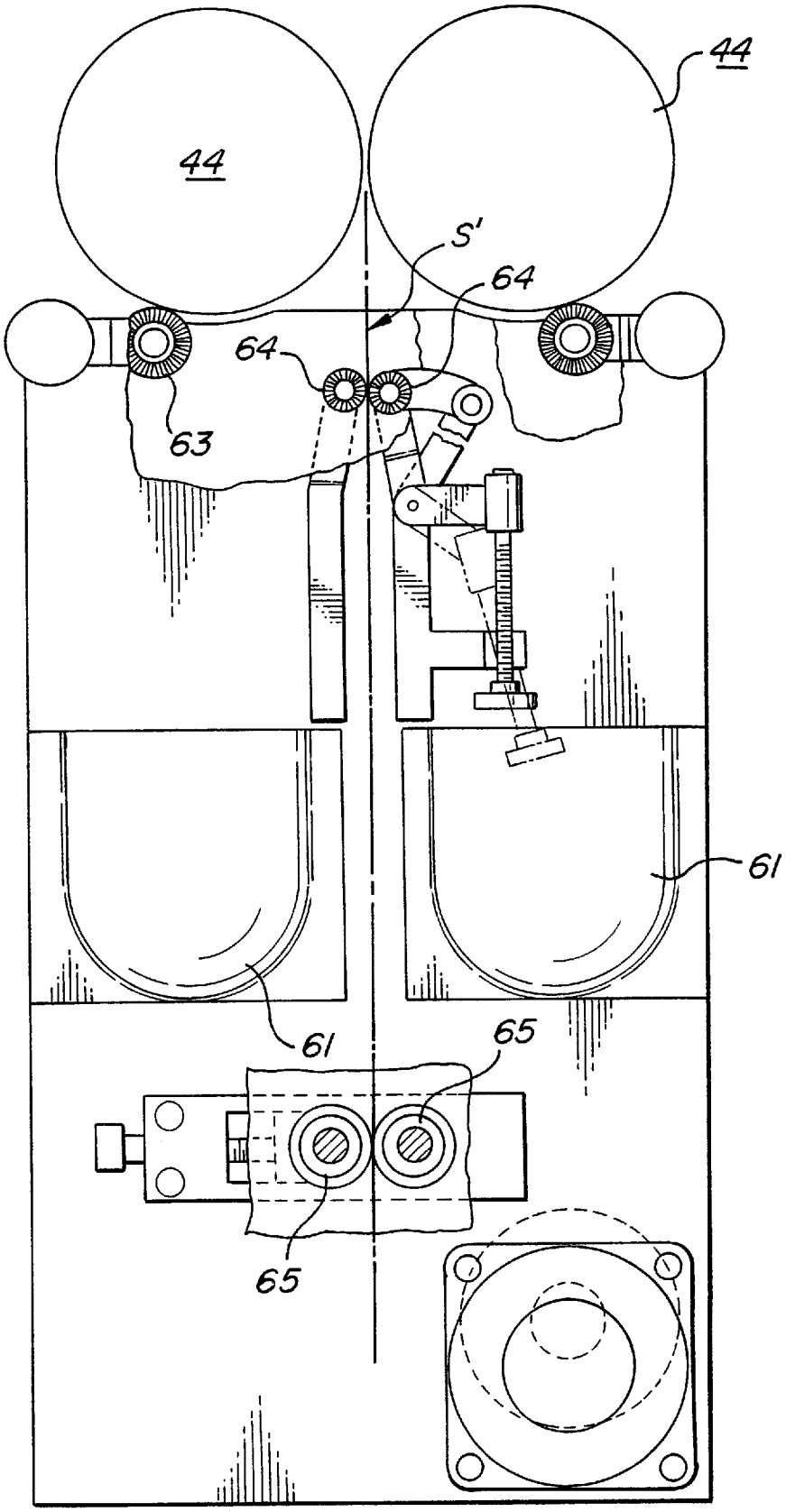
FIG. 12. A front view showing members disposed at die roll take-out side.

Members contributing to take-out of gelatin capsules A as products provided beneath the die rolls 44 are explained. As shown in FIG. 12, reference numeral 61 is a take-out trough of gelatin capsules A, and it is composed to be drawn out to the front side of the apparatus from beneath the die rolls 44.

A scraping brush 63 for die rolls contacts with each one of the die rolls 44 for taking out the gelatin capsule A caught in the forming protrusions 45 of the die rolls 44. It is also supposed that the gelatin capsules A may be left over in the blank sheets S' from which the gelatin capsules A are blanked out, and scraping brushes for blank sheet 64 for talking out the gelatin capsules A from the blank sheet S' are disposed at both sides of the blank sheet S'.

Further beneath, there is a blank sheet feed roll 65 for pulling down the blank sheet S' by force. In this apparatus, the scraping brushes 63 for die rolls, scraping brushes 64 for blank sheet, and blank sheet feed roll 65 are driven in a separate system from other driving system. This driving system is omitted herein and is described in Japanese Patent Application Publication No. 5-88145 (Patent No. 1876978).

By applying such gelatin capsule manufacturing apparatus 1, the state of action for sucking gelatin sheets S and forming the pocket P is explained. The state of action of the entire apparatus is omitted herein, and should be referred to the same Japanese Patent Publication No. 5-88145 (Patent No. 1876978).

(1) Start of Suction

Figure 13:
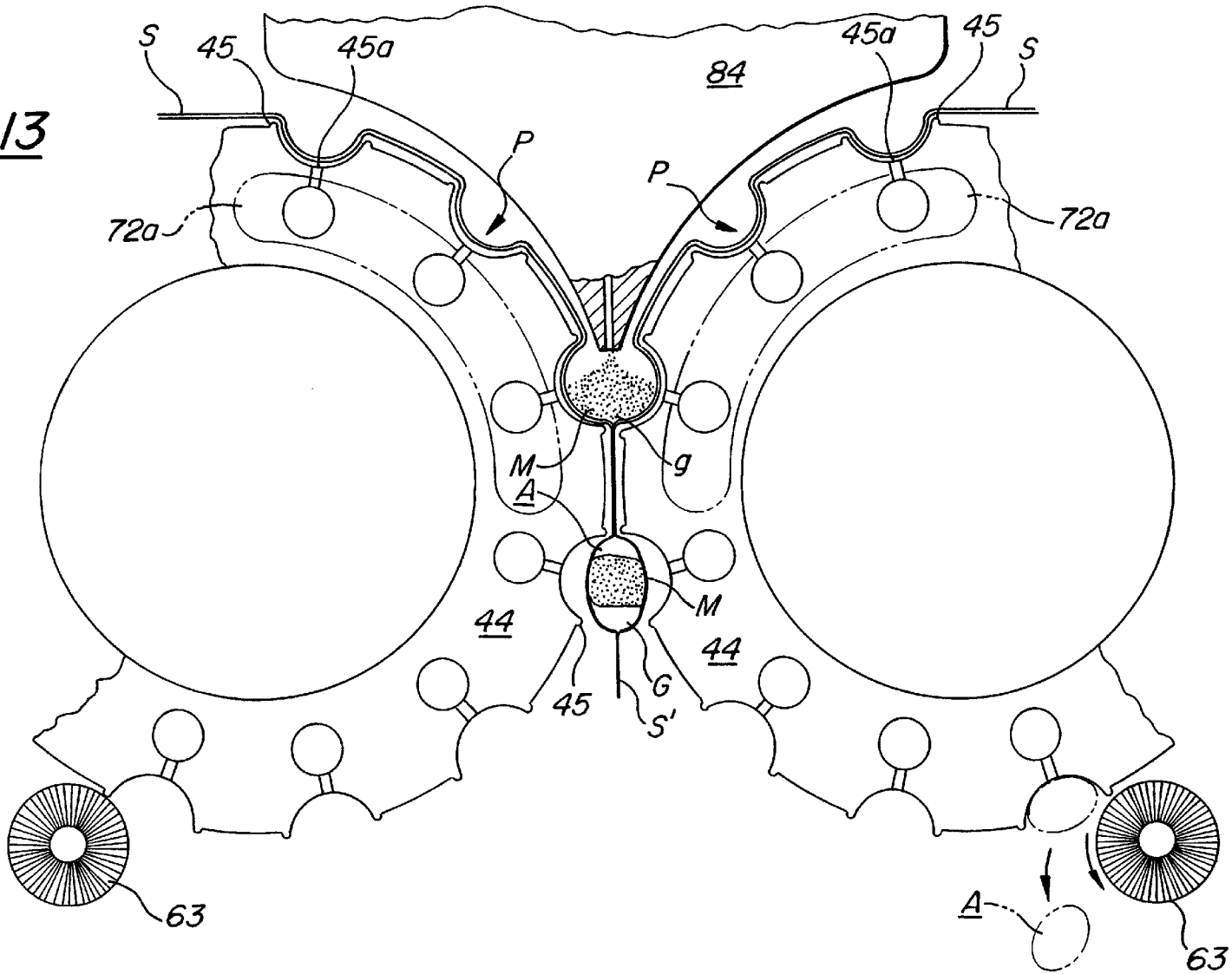
FIG. 13. A skeletal front view showing mode of forming of gelatin capsule in die rolls.

The gelatin sheet S formed by the sheet forming unit 2 is sent into the die rolls 44 through the feed roll 40. Then, as shown in FIG. 13, when the gelatin sheet S reaches the top of the die rolls 44, the suction holes 45*a* formed in the inner circumference of the forming protrusions 45 reach the suction grooves 72*a* of the suction main body 72, and suction of gelatin sheet S begins.

(2) Start of Attraction

As suction begins, the gelatin sheet S is attracted to the suction holes 45*a,* and is deformed in a shape fitted to the inner circumference of the forming protrusions 45, and the pocket P is formed, and according to the rotation of the die rolls 44, it is sent into the pair of die rolls 44 in a form like a folder.

(3) Forming of Suture

When the gelatin sheet S reaches the die rolls 44, a suture g is formed by the action of the forming protrusions 45 from the contact area, and the powder M weighed by a specific amount is supplied from the powder nozzle 84 into the pocket P. Along with rotation of the die rolls 44, the suture g spreads over the entire periphery upward from the surrounding, and formation of the suture g is over and the capsule sheath G is formed.

(4) Release of Suction

When the capsule sheath G is formed, nearly at the same time, the suction holes 45*a* reach the rotating position of 45 degrees from above, and suction is released, and formation of gelatin capsule A is complete, so that the gelatin capsule A is detached from the forming protrusions 45. In this embodiment, the suction grooves 72*a* are formed in a range of 45 degrees in the suction main body 72, and the gelatin sheet S is attracted only in this range, but the angle may be properly changed depending on the number of forming protrusions 45.

Figure 14A:
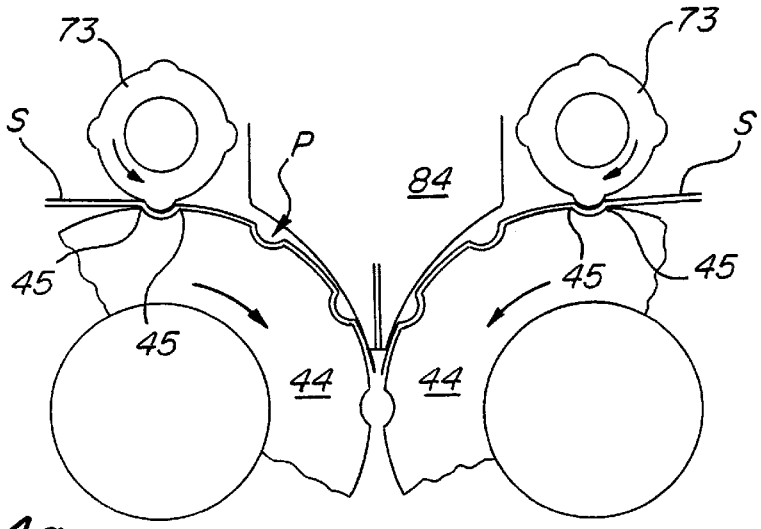
FIGS. 14(A), 14(B), 14(C). A skeletal front view showing other embodiments of forming mechanism of pocket.
Figure 14B:
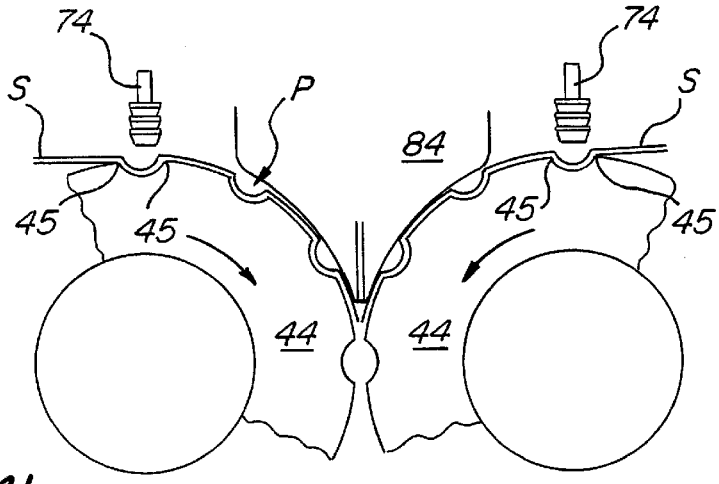
Figure 14C:
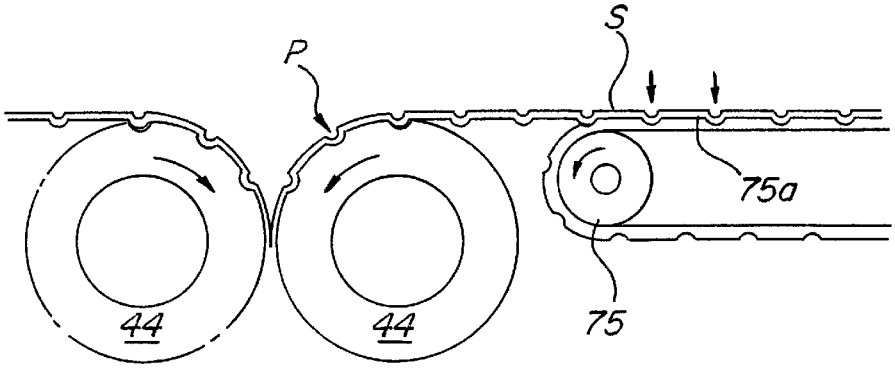
Figure 15:
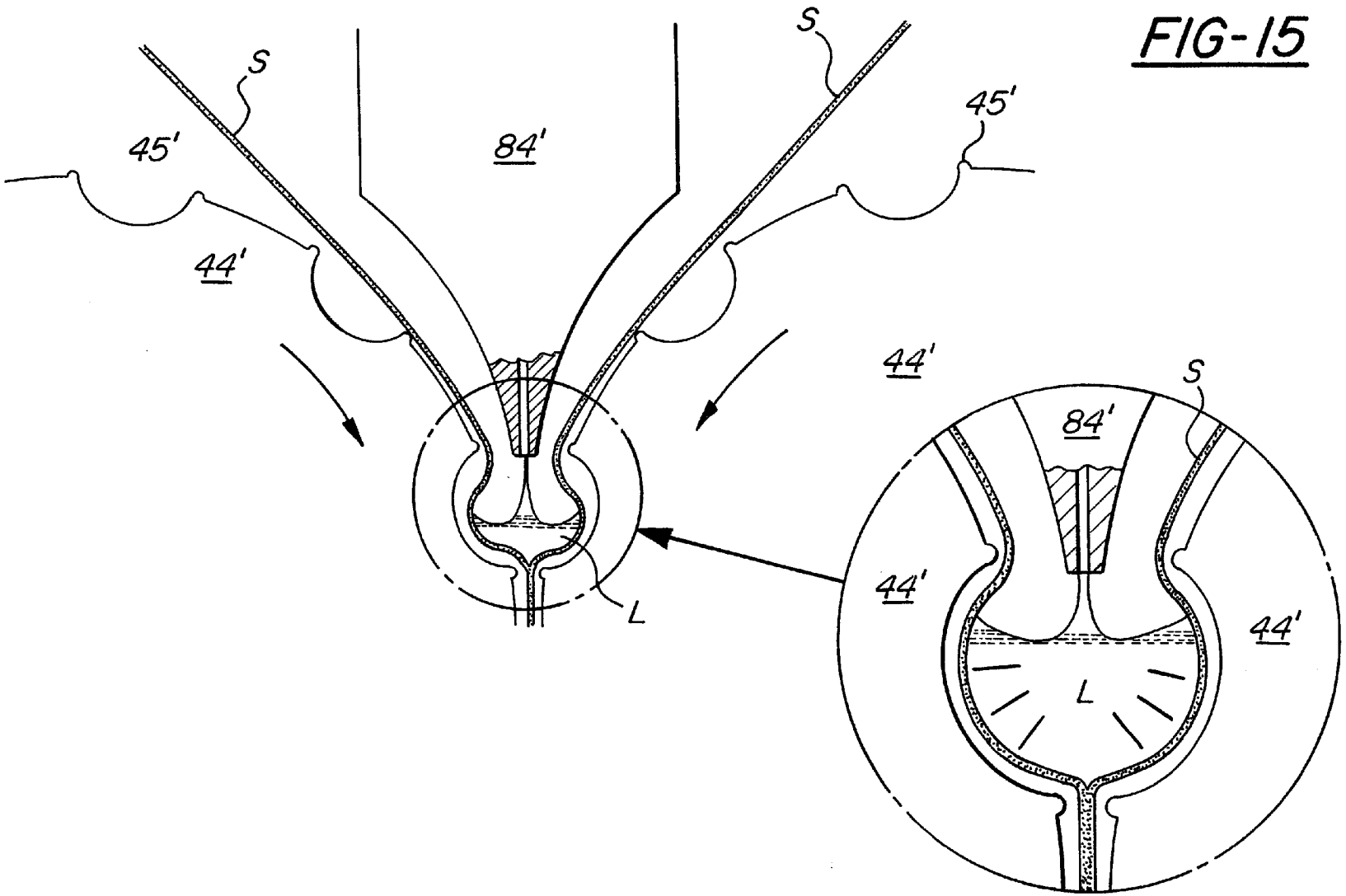
FIG. 15. A skeletal front view showing a conventional mode of forming of gelatin capsule using liquid as the content range of the gelatin sheets in a stage before the gelatin sheets supplied in the die rolls are formed integrally like a folder.

The foregoing embodiment is one basic technical concept of the invention, but following modifications are possible in the forming mechanism of the pocket P. That is, not limited to suction by suction holes 45*a* in the inner circumference of the forming protrusions 45 mentioned above, as shown in FIG. 14 (*a*), a die 73 formed in a convex shape corresponding to the inner circumference of the forming protrusions 45 formed in a recess is provided around the die rolls 44 so as to form the gelatin sheet S by embossing. Or, as shown in FIG. 14 (b), using air nozzle 74 and others, the gelatin sheet S supplied on the forming protrusions 45 may be pressed. Further, as shown in FIG. 14 (*c*) , before being supplied into the die rolls 44, using a conveyor 75 having a recess forming unit 75*a,* an external force of suction or pressing is applied also when the gelatin sheet S passes on the conveyor 75, and a pocket P is formed in the gelatin sheet S, and various other modifications are possible.

According to the invention as the gelatin capsule A containing only powder or pellets M different from liquid can be manufactured, and easy-to-take gelatin capsules A are wide in variety. Besides, the method for forming the pocket P for enveloping the powder or pellets M in the gelatin sheet S is realized in various manners such as suction, embossing, and pressing, and the forming position may be properly selected.

Further, according to the invention the sheet suction mechanism 70 or sucking the gelatin sheet S may be applied in the conventional manufacturing apparatus, and the cost of gelatin capsules A containing powder or pellets M may be lowered.

Having described my invention, additional embodiments will become apparent to those skilled in the art to which it pertains without deviating from the scope of the appended claims.

What is claimed is:

1. A manufacturing method of gelatin capsules comprising the steps of:

supplying two gelatin sheets having preliminarily preformed pockets between a pair of die rolls for forming a capsule sheath in a gelatin capsule;

preliminarily suturing said two gelatin sheets by action of said die rolls to form a pocket;

weighing a predetermined amount of a capsule content in a weighing hole aligned with said pocket, said capsule content comprising a fine or granular powder or time release pellets;

driving a pusher through said weighing hole to thereby drive said weighed amount of capsule content into said pocket; and thereafter suturing said two gelatin sheets by action of said die rolls to envelop said capsule content in said pocket.

2. A manufacturing method of gelatin capsule of claim 1, wherein the pockets in said gelatin sheets are formed by sucking from the inside of forming protrusions on the die rolls for forming a capsule sheath in a gelatin capsule.

* * * * *